US010457307B2

(12) United States Patent
Schultz et al.

(10) Patent No.: US 10,457,307 B2
(45) Date of Patent: Oct. 29, 2019

(54) WIRELESS CROSSING ACTIVATION SYSTEM AND METHOD

(71) Applicant: Westinghouse Air Brake Technologies Corporation, Wilmerding, PA (US)

(72) Inventors: Timothy Allen Schultz, Marion, IA (US); Jeffrey D. Kernwein, Cedar Rapids, IA (US); Scott A. Sollars, Lee's Summit, MO (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 433 days.

(21) Appl. No.: 15/176,537

(22) Filed: Jun. 8, 2016

(65) Prior Publication Data

US 2017/0355388 A1 Dec. 14, 2017

(51) Int. Cl.

| | |
|---|---|
| ***B61L 29/32*** | (2006.01) |
| ***B61L 7/06*** | (2006.01) |
| ***B61L 25/02*** | (2006.01) |
| ***B61L 29/04*** | (2006.01) |

(52) U.S. Cl.
CPC ..... *B61L 29/32* (2013.01); *B61L 7/06* (2013.01); *B61L 25/021* (2013.01); *B61L 25/025* (2013.01); *B61L 29/04* (2013.01)

(58) Field of Classification Search
CPC ..... B61L 29/22; B61L 29/32; B61L 25/021; B61L 25/025
USPC ..... 246/125, 126, 293
See application file for complete search history.

(56) References Cited

U.S. PATENT DOCUMENTS

| | | | | |
|---|---|---|---|---|
| 4,617,627 | A | 10/1986 | Yasunobu et al. | |
| 6,572,056 | B2 | 6/2003 | Berry et al. | |
| 7,575,202 | B2 | 8/2009 | Sharkey et al. | |
| 7,832,691 | B2 | 11/2010 | Reibeling et al. | |
| 8,214,091 | B2 * | 7/2012 | Kernwein | B61L 25/025 246/122 R |
| 8,370,006 | B2 | 2/2013 | Kumar et al. | |
| 8,833,703 | B2 | 9/2014 | Steffen, II et al. | |
| 8,924,066 | B2 * | 12/2014 | Fries | B61L 27/0077 246/125 |
| 9,026,360 | B2 | 5/2015 | Fries et al. | |
| 9,126,609 | B2 | 9/2015 | Steffen, II et al. | |
| 9,150,229 | B2 | 10/2015 | Steffen et al. | |
| 2008/0201028 | A1 | 8/2008 | Brooks et al. | |
| 2009/0115633 | A1 | 5/2009 | Lawry et al. | |

(Continued)

*Primary Examiner* — Zachary L Kuhfuss
(74) *Attorney, Agent, or Firm* — The Webb Law Firm

(57) ABSTRACT

A wireless target activation system for a train, the system including at least one computer programmed or configured to: receive at least one first target location and at least one second target location associated with a forward route of the train, wherein the at least one first target location is located before the at least one second target location on the forward route of the train; determine a gap time between when the leading edge of the train leaves the at least one first target location and is estimated to arrive at the at least one second target location based at least partially on a distance between the at least one first target location and the at least one second target location and a design speed; and based at least partially on the gap time, an allowable acceleration of the train, and a required warning time, generate an activation message configured to activate or cause the activation of at least one function associated with the at least one second target location.

16 Claims, 6 Drawing Sheets

(56) References Cited

U.S. PATENT DOCUMENTS

| | | | | |
|---|---|---|---|---|
| 2009/0184214 | A1 | 7/2009 | Reibeling et al. | |
| 2012/0245770 | A1 | 9/2012 | Yamamoto et al. | |
| 2013/0171590 | A1 | 7/2013 | Kumar | |
| 2013/0325224 | A1 | 12/2013 | Yamamoto et al. | |
| 2014/0191090 | A1 | 7/2014 | Busse et al. | |
| 2014/0346284 | A1* | 11/2014 | Fries | B61L 13/00 246/125 |
| 2016/0362123 | A1* | 12/2016 | Schultz | B61L 25/025 |

* cited by examiner

WIRELESS CROSSING ACTIVATION SYSTEM AND METHOD

BACKGROUND OF THE INVENTION

Field of the Invention

This invention relates generally to vehicle systems and control processes, such as railway systems including trains travelling in a track or rail network, and in particular to a wireless target activation system and method that may be used in connection with navigation in railway networks, such as in connection with railway networks that include target locations (e.g., a crossing, a safety target, a track section, a track location, a specified location, a restricted speed location, a circuit, a restricted noise location, and the like).

Description of Related Art

Vehicle systems and networks exist throughout the world, and, at any point in time, a multitude of vehicles, such as cars, trucks, buses, trains, and the like, are travelling throughout the system and network. With specific reference to trains travelling in a track network, the locomotives of such trains are typically equipped with or operated using train control, communication, and management systems (e.g., positive train control (PTC) systems), such as the I-ETMS® of Wabtec Corp. In order to effectively manage all of the trains, navigation and enforcement systems and processes are implemented, both at the train level and the central dispatch level.

With respect to existing PTC systems and processes, a station stop located on an approach circuit can result in a crossing warning activation time that exceeds the minimum required Federal Railroad Administration (FRA) warning cycle, thereby causing long wait times for vehicular and pedestrian traffic. Contrary to conventional thought, a longer crossing activation cycle does not create a safer crossing. Excessive wait times can result in impatient drivers who may drive around the gates of the crossing instead of waiting for the train to pass. Therefore, it is desirable to reduce warning time for the sake of railroad efficiency and safety. Furthermore, existing PTC systems and processes cannot dynamically adjust to changes in train handling, and they are configured to use only a static station dwell time and a maximum crossing time. Moreover, existing PTC systems and processes do not employ a targeting methodology and, therefore, cannot prevent the train from arriving too early or too late to the crossing.

For at least these reasons, there is a need in the art for improved wireless target activation systems and methods, for example, an improved station stop algorithm for wireless crossing activation. By accounting for the acceleration/deceleration time of the train, the train can dynamically adjust to changes in dwell time, and work with time-based targeting to ensure that the train does not violate required warning times.

SUMMARY OF THE INVENTION

Generally, provided are an improved wireless target activation system and computer-implemented method, preferably for use in connection with trains travelling in a track network. Preferably, provided are a wireless target activation system and computer-implemented method that provide an improved station stop algorithm and wireless crossing activation. Preferably, provided are a wireless target activation system and computer-implemented method that generate, based at least partially on an allowable acceleration/deceleration of the train and a required warning time, an activation message configured to activate at least one function associated with at least one target location, such as, a wireless crossing activation. Preferably, provided are a wireless target activation system and computer-implemented method that provide a solution for reducing a crossing warning time by activating a crossing, via a station release message, at a more optimal time. Preferably, provided are wireless target activation system and computer-implemented method that dynamically adjust to changes in train dwell time at a station stop signal and can detect an early departure of the train from the station stop signal. Preferably, provided are a wireless target activation system and computer-implemented method that work with time-based targeting to ensure a train does not violate a required warning time. Preferably, provided are a wireless target activation system and computer-implemented method that generate a message configured to activate at least one crossing associated with a forward route of the train in response to actuation of at least one locomotive control by an operator of the train.

According to one preferred and non-limiting embodiment or aspect, provided is a wireless target activation system for a train comprising at least one locomotive or control car, the system comprising at least one computer programmed or configured to: receive at least one first target location associated with a forward route of the train; receive at least one second target location associated with the forward route of the train, wherein the at least one first target location is located before the at least one second target location on the forward route of the train; determine a gap time between when the leading edge of the train leaves the at least one first target location and is estimated to arrive at the at least one second target location based at least partially on a distance between the at least one first target location and the at least one second target location and a design speed; and based at least partially on the gap time, an allowable acceleration of the train, and a required warning time, generate an activation message configured to activate or cause the activation of at least one function associated with the at least one second target location.

In one preferred and non-limiting embodiment or aspect, the activation message is generated after the leading edge of the train leaves the at least one first target location.

In one preferred and non-limiting embodiment or aspect, the activation message is generated before the leading edge of the train leaves the at least one first target location.

In one preferred and non-limiting embodiment or aspect, the at least one computer is programmed or configured to automatically generate the activation message if the leading edge of the train leaves the at least one first target location at a time when a summation of the gap time and the allowable acceleration is less than the required warning time.

In one preferred and non-limiting embodiment or aspect, the at least one computer is programmed or configured to: determine an estimated time of arrival of the leading edge of the train at the at least one first target location based at least partially on the current location of the leading edge of the train and the current speed of the train; and based at least partially on the estimated time of arrival of the leading edge of the train at the at least one first target location, a dwell time of the train at the at least one first target location, the gap time, the allowable acceleration of the train, and the required warning time, generate the activation message configured to activate or cause the activation of the function associated with the at least one second target location.

In one preferred and non-limiting embodiment or aspect, the activation message is generated before the leading edge of the train leaves at the at least one first target location.

In one preferred and non-limiting embodiment or aspect, the at least one computer is programmed or configured to automatically generate the activation message if the leading edge of the train leaves the at least one first target location at a time when a summation of the gap time and the allowable acceleration is less than the required warning time.

In one preferred and non-limiting embodiment or aspect, the activation message is generated after the leading edge of the train leaves the at least one first target location.

In one preferred and non-limiting embodiment or aspect, the at least one computer is programmed or configured to generate at least one inhibit message configured to inhibit or prevent, or cause the inhibition or prevention of, activation of the function of the at least one second target.

In one preferred and non-limiting embodiment or aspect, the at least one computer is programmed or configured to generate the inhibit message before the leading edge of the train arrives at at least one third target location, the at least one third target location before the at least first target location and the at least one second target location on the forward route of the train.

In one preferred and non-limiting embodiment or aspect, the design speed is a design speed associated with the at least one second target.

In one preferred and non-limiting embodiment or aspect, the at least one computer is programmed or configured to: determine required time of arrival of the leading edge of the train at the at least one second target location based at least partially on the required warning time; determine the estimated time of arrival of the leading edge of the train at the at least one second target location based at least partially on a location of the leading edge of the train and a speed of the train after the leading edge of the train leaves the at least one first target location; and based at least partially on the difference between the determined required time of arrival and the determined estimated time of arrival, generate a target speed of the train.

In one preferred and non-limiting embodiment or aspect, if the distance between the at least one first target location and the at least one second target location is too short to reach the design speed based on the allowable acceleration, the at least one computer is programmed or configured to set the design speed of the train to be the following: $\sqrt{(2*a*gd)}$ wherein a is the allowable acceleration and gd is the distance between the at least one first target location and the at least one second target location.

In one preferred and non-limiting embodiment or aspect, the at least one first target location comprises a station stop signal and the at least one second target location comprises a near side of an island crossing.

In one preferred and non-limiting embodiment or aspect, the activation message comprises a timestamp that indicates a time at which to activate the at least one function associated with the at least one second target location.

According to one preferred and non-limiting embodiment or aspect, provided is a wireless target activation system for a train comprising at least one locomotive or control car, the system comprising an at least one computer programmed or configured to: receive at least one first target location associated with a forward route of the train; receive at least one second target location associated with the forward route of the train, wherein the at least one first target location is located before the at least one second target location on the forward route of the train; determine an estimated time of arrival of the leading edge of the train at the at least one first target location based at least partially on the current location of the leading edge of the train and the current speed of the train; determine a gap time between when the leading edge of the train leaves the at least one first target location and is estimated to arrive at the at least one second target location based at least partially on a distance between the at least one first target location and the at least one second target location and a design speed of the train; and based at least partially on the estimated time of arrival of the leading edge of the train at the at least one first target location, a dwell time of the leading edge of the train at the at least one first target location, the gap time, an allowable acceleration of the train, and a required warning time, generate an activation message configured to activate or cause the activation of a function associated with the at least one second target location.

According to one preferred and non-limiting embodiment or aspect, provided is a wireless crossing activation system for a train comprising at least one locomotive or control car, the system comprising at least one computer programmed or configured to generate a message configured to activate or cause the activation of at least one crossing associated with a forward route of the train in response to actuation of at least one locomotive control.

In one preferred and non-limiting embodiment or aspect, the at least one computer is programmed or configured to enable or facilitate actuation of the locomotive control based on at least one of a location of the leading edge of the train and a speed of the train.

In one preferred and non-limiting embodiment or aspect, the at least one computer is programmed or configured to enable or facilitate actuation of the locomotive control in response to a message received from a station stop located in advance of the crossing on the forward route of the train.

According to one preferred and non-limiting embodiment or aspect, provided is a computer-implemented wireless target activation method for a train comprising at least one locomotive or control car, the method comprising: receiving at least one first target location associated with a forward route of the train; receiving at least one second target location associated with the forward route of the train, wherein the at least one first target location is located before the at least one second target location on the forward route of the train; determining a gap time between when the leading edge of the train leaves the at least one first target location and is estimated to arrive at the at least one second target location based at least partially on a distance between the at least one first target location and the at least one second target location and a design speed; and based at least partially on the gap time, an allowable acceleration of the train, and a required warning time, generating an activation message configured to activate or cause the activation of at least one function associated with the at least one second target location.

According to one preferred and non-limiting embodiment or aspect, provided is a computer-implemented wireless target activation method for a train comprising at least one locomotive or control car, the method comprising: enabling or facilitating actuation of at least one locomotive control; and generating a message configured to activate or cause the activation of at least one crossing associated with a forward route of the train in response to actuation of the at least one locomotive control.

Other preferred and non-limiting embodiments or aspects of the present invention will be set forth in the following numbered clauses:

Clause 1. A wireless target activation system for a train comprising at least one locomotive or control car, the system comprising at least one computer programmed or configured to: receive at least one first target location associated with a forward route of the train; receive at least one second target location associated with the forward route of the train, wherein the at least one first target location is located before the at least one second target location on the forward route of the train; determine a gap time between when the leading edge of the train leaves the at least one first target location and is estimated to arrive at the at least one second target location based at least partially on a distance between the at least one first target location and the at least one second target location and a design speed; and based at least partially on the gap time, an allowable acceleration of the train, and a required warning time, generate an activation message configured to activate or cause the activation of at least one function associated with the at least one second target location.

Clause 2. The wireless target activation system of clause 1, wherein the activation message is generated after the leading edge of the train leaves the at least one first target location.

Clause 3. The wireless target activation system of clause 1 or 2, wherein the activation message is generated before the leading edge of the train leaves the at least one first target location.

Clause 4. The wireless target activation system of any of clauses 1-3, wherein the at least one computer is programmed or configured to automatically generate the activation message if the leading edge of the train leaves the at least one first target location at a time when a summation of the gap time and the allowable acceleration is less than the required warning time.

Clause 5. The wireless target activation system of any of clauses 1-4, wherein the at least one computer is programmed or configured to: determine an estimated time of arrival of the leading edge of the train at the at least one first target location based at least partially on the current location of the leading edge of the train and the current speed of the train; and based at least partially on the estimated time of arrival of the leading edge of the train at the at least one first target location, a dwell time of the train at the at least one first target location, the gap time, the allowable acceleration of the train, and the required warning time, generate the activation message configured to activate or cause the activation of the function associated with the at least one second target location.

Clause 6. The wireless target activation system of any of clauses 1-5, wherein the activation message is generated before the leading edge of the train leaves at the at least one first target location.

Clause 7. The wireless target activation system of any of clauses 1-6, wherein the at least one computer is programmed or configured to automatically generate the activation message if the leading edge of the train leaves the at least one first target location at a time when a summation of the gap time and the allowable acceleration is less than the required warning time.

Clause 8. The wireless target activation system of any of clauses 1-7, wherein the activation message is generated after the leading edge of the train leaves the at least one first target location.

Clause 9. The wireless target activation system of any of clauses 1-8, wherein the at least one computer is programmed or configured to generate at least one inhibit message configured to inhibit or prevent, or cause the inhibition or prevention of, activation of the function of the at least one second target.

Clause 10. The wireless target activation system of any of clauses 1-9, wherein the at least one computer is programmed or configured to generate the inhibit message before the leading edge of the train arrives at at least one third target location, the at least one third target location before the at least first target location and the at least one second target location on the forward route of the train.

Clause 11. The wireless target activation system of any of clauses 1-10, wherein the design speed is a design speed associated with the at least one second target.

Clause 12. The wireless target activation system of any of clauses 1-11, wherein the at least one computer is programmed or configured to: determine required time of arrival of the leading edge of the train at the at least one second target location based at least partially on the required warning time; determine the estimated time of arrival of the leading edge of the train at the at least one second target location based at least partially on a location of the leading edge of the train and a speed of the train after the leading edge of the train leaves the at least one first target location; and based at least partially on the difference between the determined required time of arrival and the determined estimated time of arrival, generate a target speed of the train.

Clause 13. The wireless target activation system of any of clauses 1-12, wherein if the distance between the at least one first target location and the at least one second target location is too short to reach the design speed based on the allowable acceleration, the at least one computer is programmed or configured to set the design speed of the train to be the following: $\sqrt{(2*a*gd)}$ wherein a is the allowable acceleration and gd is the distance between the at least one first target location and the at least one second target location.

Clause 14. The wireless target activation system of any of clauses 1-13, wherein the at least one first target location comprises a station stop signal and the at least one second target location comprises a near side of an island crossing.

Clause 15. The wireless target activation system of any of clauses 1-14, wherein the activation message comprises a timestamp that indicates a time at which to activate the at least one function associated with the at least one second target location.

Clause 16. A wireless target activation system for a train comprising at least one locomotive or control car, the system comprising an at least one computer programmed or configured to: receive at least one first target location associated with a forward route of the train; receive at least one second target location associated with the forward route of the train, wherein the at least one first target location is located before the at least one second target location on the forward route of the train; determine an estimated time of arrival of the leading edge of the train at the at least one first target location based at least partially on the current location of the leading edge of the train and the current speed of the train; determine a gap time between when the leading edge of the train leaves the at least one first target location and is estimated to arrive at the at least one second target location based at least partially on a distance between the at least one first target location and the at least one second target location and a design speed of the train; and based at least partially on the estimated time of arrival of the leading edge of the train at the at least one first target location, a dwell time of the leading edge of the train at the at least one first target location, the gap time, an allowable acceleration of the train, and a required warning time, generate an activation message configured to activate or cause the activation of a function associated with the at least one second target location.

Clause 17. A wireless crossing activation system for a train comprising at least one locomotive or control car, the system comprising at least one computer programmed or configured to generate a message configured to activate or cause the activation of at least one crossing associated with a forward route of the train in response to actuation of at least one locomotive control.

Clause 18. The wireless crossing activation system of clause 17, wherein the at least one computer is programmed or configured to enable or facilitate actuation of the locomotive control based on at least one of a location of the leading edge of the train and a speed of the train.

Clause 19. The wireless crossing activation system of clause 17 or 18, wherein the at least one computer is programmed or configured to enable or facilitate actuation of the locomotive control in response to a message received from a station stop located in advance of the crossing on the forward route of the train.

Clause 20. A computer-implemented wireless target activation method for a train comprising at least one locomotive or control car, the method comprising: receiving at least one first target location associated with a forward route of the train; receiving at least one second target location associated with the forward route of the train, wherein the at least one first target location is located before the at least one second target location on the forward route of the train; determining a gap time between when the leading edge of the train leaves the at least one first target location and is estimated to arrive at the at least one second target location based at least partially on a distance between the at least one first target location and the at least one second target location and a design speed; and based at least partially on the gap time, an allowable acceleration of the train, and a required warning time, generating an activation message configured to activate or cause the activation of at least one function associated with the at least one second target location.

Clause 21. A computer-implemented wireless target activation method for a train comprising at least one locomotive or control car, the method comprising: enabling or facilitating actuation of at least one locomotive control; and generating a message configured to activate or cause the activation of at least one crossing associated with a forward route of the train in response to actuation of the at least one locomotive control.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
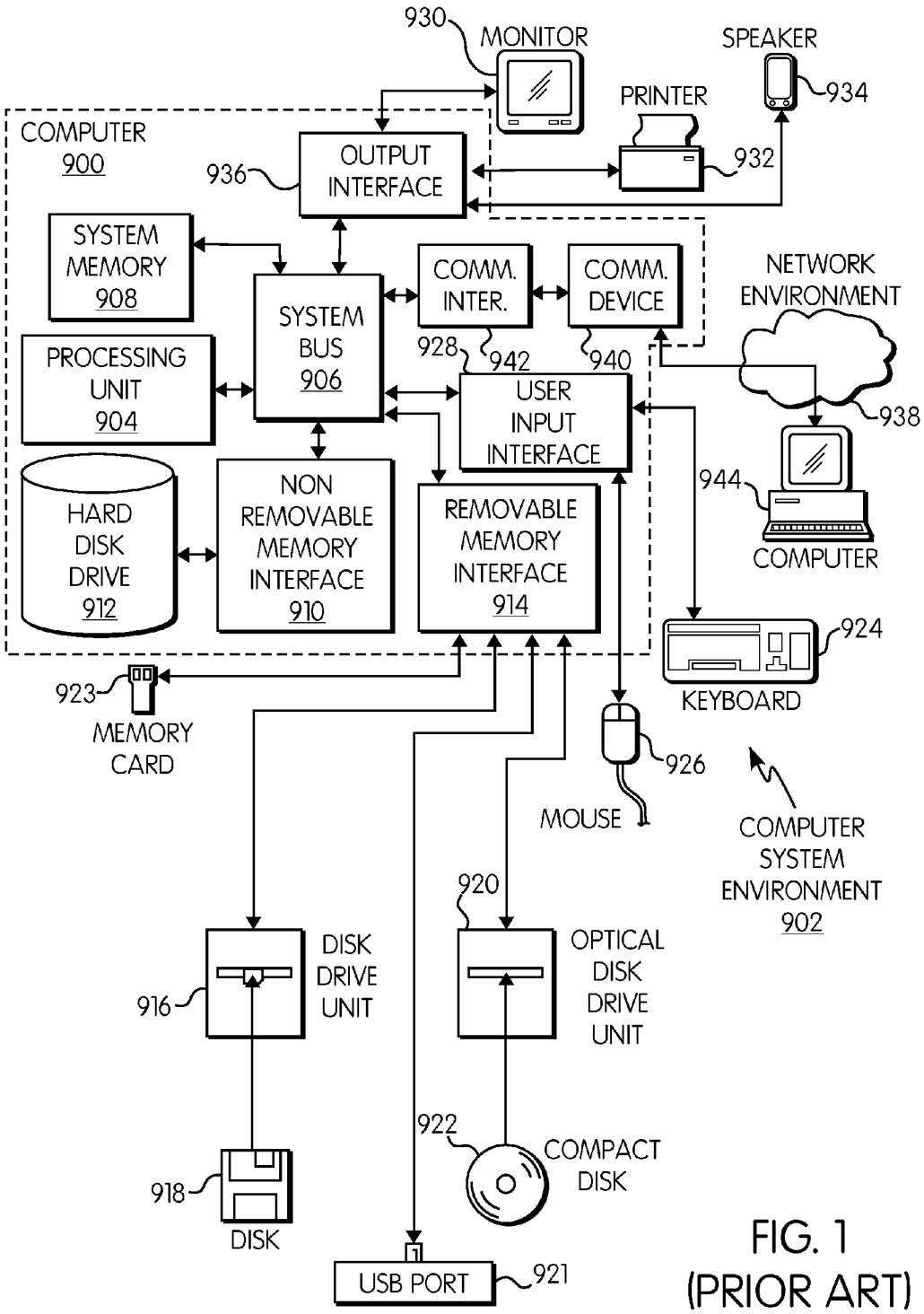
FIG. 1 (PRIOR ART)
FIG. 1 is a schematic view of a computer system and environment according to the prior art.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, and/or the like. It is to be noted that a "communication device" includes any device that facilitates communication (whether wirelessly or hard-wired (e.g., over the rails of a track, over a trainline extending between railcars of a train, and the like)) between two units, such as two locomotive units or control cars. In one preferred and non-limiting embodiment or aspect, the "communication device" is a radio transceiver programmed, configured, or adapted to wirelessly transmit and receive radio frequency signals and data over a radio signal communication path.

The wireless target activation system and computer-implemented method described herein may be implemented in a variety of systems and vehicular networks; however, the systems and methods described herein are particularly useful in connection with a railway system and network. Accordingly, the presently-invented methods and systems can be implemented in various known train control and management systems, e.g., the I-ETMS® of Wabtec Corp. The systems and methods described herein are useful in connection with and/or at least partially implemented on one or more locomotives or control cars (L) that make up a train (TR). It should be noted that multiple locomotives or control cars (L) may be included in the train (TR) to facilitate the reduction of the train (TR) to match with passenger (or some other) demand or requirement. Further, the method and systems described herein can be used in connection with commuter trains, freight train, and/or other train arrangements and systems. For example, a station stop signal or other reason for a train stop can be associated with a commuter rail station stop or for other railroad functions, such as, crew changes.

In one preferred and non-limiting embodiment or aspect, the methods and systems described herein are used in connection with the locomotives or controls cars (L) that are positioned on each end of the train (TR), while in other preferred and non-limiting embodiments or aspects, the methods and systems described herein are used in connection with locomotives or control cars (L) that are positioned intermediately in the train (TR) (since these intermediate locomotives or control cars (L) may eventually become a controlling locomotive or control car (L) when the train (TR) is reconfigured). It is also noted that the methods and systems described herein may be used in connection with "electrical multiple unit" (EMU) or "diesel multiple unit" (DMU) configurations, where a locomotive does not technically exist, but multiple control cars would still be present. Still further, the train (TR) may include only one locomotive or control car (L) and/or some or no railroad cars. It should be noted that multiple locomotives or control cars (L) may be included in the train (TR) to facilitate the reduction of the train (TR) to match with passenger (or some other) demand or requirement. Further, the method and systems described herein can be used in connection with commuter trains, freight trains, push-pull train configurations, and/or other train arrangements and systems. Still further, the train (TR) may be separated into different configurations (e.g., other trains (TR)) and moved in either a first direction and/or a second direction. Any configuration or arrangement of locomotives, control cars, and/or railroad cars may be designated as a train and/or a consist. Still further, it is to be expressly understood that the presently-invented methods and systems described herein may be implemented on and/or used in connection with an auxiliary vehicle, such as an auxiliary railroad vehicle, a maintenance vehicle or machine, a road vehicle (e.g., truck, pick-up truck, car, or other machine), a vehicle equipped to ride on the rails of the track, and/or the like.

As shown in FIG. 1, and according to the prior art, personal computers 900, 944, in a computing system environment 902 may be provided or utilized, such as in connection with the on-board computer described below. This computing system environment 902 may include, but is not limited to, at least one computer 900 having certain components for appropriate operation, execution of code, and creation and communication of data. For example, the computer 900 includes a processing unit 904 (typically referred to as a central processing unit or CPU) that serves to execute computer-based instructions received in the appropriate data form and foimat. Further, this processing unit 904 may be in the form of multiple processors executing code in series, in parallel, or in any other manner for appropriate implementation of the computer-based instructions.

In order to facilitate appropriate data communication and processing information between the various components of the computer 900, a system bus 906 is utilized. The system bus 906 may be any of several types of bus structures, including a memory bus or memory controller, a peripheral bus, or a local bus using any of a variety of bus architectures. In particular, the system bus 906 facilitates data and information communication between the various components (whether internal or external to the computer 900) through a variety of interfaces, as discussed hereinafter.

The computer 900 may include a variety of discrete computer-readable media components. For example, this computer-readable media may include any media that can be accessed by the computer 900, such as volatile media, non-volatile media, removable media, non-removable media, etc. As a further example, this computer-readable media may include computer storage media, such as media implemented in any method or technology for storage of information, such as computer-readable instructions, data structures, program modules, or other data, random access memory (RAM), read only memory (ROM), electrically erasable programmable read only memory (EEPROM), flash memory, or other memory technology, CD-ROM, digital versatile disks (DVDs), or other optical disk storage, magnetic cassettes, magnetic tape, magnetic disk storage, or other magnetic storage devices, or any other medium which can be used to store the desired information and which can be accessed by the computer 900. Further, this computer-readable media may include communications media, such as computer-readable instructions, data structures, program modules, or other data in other transport mechanisms and include any information delivery media, wired media (such as a wired network and a direct-wired connection), and wireless media. Computer-readable media may include all machine-readable media with the sole exception of transitory, propagating signals. Of course, combinations of any of the above should also be included within the scope of computer-readable media.

As seen in FIG. 1, the computer 900 further includes a system memory 908 with computer storage media in the form of volatile and non-volatile memory, such as ROM and RAM. A basic input/output system (BIOS) with appropriate computer-based routines assists in transferring information between components within the computer 900 and is normally stored in ROM. The RAM portion of the system memory 908 typically contains data and program modules that are immediately accessible to or presently being operated on by processing unit 904, e.g., an operating system, application programming interfaces, application programs, program modules, program data and other instruction-based computer-readable codes.

With continued reference to FIG. 1, the computer 900 may also include other removable or non-removable, volatile or non-volatile computer storage media products. For example, the computer 900 may include a non-removable memory interface 910 that communicates with and controls a hard disk drive 912, i.e., a non-removable, non-volatile magnetic medium; and a removable, non-volatile memory interface 914 that communicates with and controls a magnetic disk drive unit 916 (which reads from and writes to a removable, non-volatile magnetic disk 918), an optical disk drive unit 920 (which reads from and writes to a removable, non-volatile optical disk 922, such as a CD ROM), a Universal Serial Bus (USB) port 921 for use in connection with a removable memory card, etc. However, it is envisioned that other removable or non-removable, volatile or non-volatile computer storage media can be used in the exemplary computing system environment 900, including, but not limited to, magnetic tape cassettes, DVDs, digital video tape, solid state RAM, solid state ROM, etc. These various removable or non-removable, volatile or non-volatile magnetic media are in communication with the processing unit 904 and other components of the computer 900 via the system bus 906. The drives and their associated computer storage media discussed above and illustrated in FIG. 1 provide storage of operating systems, computer-readable instructions, application programs, data structures, program modules, program data and other instruction-based computer-readable code for the computer 900 (whether duplicative or not of this information and data in the system memory 908).

A user may enter commands, information, and data into the computer 900 through certain attachable or operable input devices, such as a keyboard 924, a mouse 926, etc., via a user input interface 928. Of course, a variety of such input devices may be utilized, e.g., a microphone, a trackball, a joystick, a touchpad, a touch-screen, a scanner, etc., including any arrangement that facilitates the input of data, and information to the computer 900 from an outside source. As discussed, these and other input devices are often connected to the processing unit 904 through the user input interface 928 coupled to the system bus 906, but may be connected by other interface and bus structures, such as a parallel port, game port, or a Universal Serial Bus (USB). Still further, data and information can be presented or provided to a user in an intelligible form or format through certain output devices, such as a monitor 930 (to visually display this information and data in electronic form), a printer 932 (to physically display this information and data in print form), a speaker 934 (to audibly present this information and data in audible form), etc. All of these devices are in communication with the computer 900 through an output interface 936 coupled to the system bus 906. It is envisioned that any such peripheral output devices be used to provide information and data to the user.

The computer 900 may operate in a network environment 938 through the use of a communications device 940, which is integral to the computer or remote therefrom. This communications device 940 is operable by and in communication to the other components of the computer 900 through a communications interface 942. Using such an arrangement, the computer 900 may connect with or otherwise communicate with one or more remote computers, such as a remote computer 944, which may be a personal computer, a server, a router, a network personal computer, a peer device, or other common network nodes, and typically includes many or all of the components described above in connection with the computer 900. Using appropriate communication devices 940, e.g., a modern, a network interface or adapter, etc., the computer 900 may operate within and communicate through a local area network (LAN) and a wide area network (WAN), but may also include other networks such as a virtual private network (VPN), an office network, an enterprise network, an intranet, the Internet, etc. It will be appreciated that the network connections shown are exemplary and other means of establishing a communications link between the computers 900, 944 may be used.

As used herein, the computer 900 includes or is operable to execute appropriate custom-designed or conventional software to perform and implement the processing steps of the method and system of the present invention, thereby, forming a specialized and particular computing system. Accordingly, the presently-invented method and system may include one or more computers 900 or similar computing devices having a computer-readable storage medium capable of storing computer-readable program code or instructions that cause the processing unit 904 to execute, configure or otherwise implement the methods, processes, and transformational data manipulations discussed hereinafter in connection with the present invention. Still further, the computer 900 may be in the form of any type of computing device having the necessary processing hardware to appropriately process data to effectively implement the presently-invented computer-implemented method and system.

As discussed hereinafter, the wireless target activation system and method of the present invention may be implemented by, programmed or configured on, or otherwise associated with any type of computer or processor, such as one or more of the following: a specially-programmed computer, an on-board controller, an on-board computer 10 (as discussed hereinafter), a train management computer, a remote server, a back office server, a wayside device, a PTC component, a networked computer, or any combination thereof. Accordingly, some or all of the steps in the system, process, and method discussed hereinafter may be implemented and/or executed on-board a locomotive or control car (L), and similarly, some or all of the steps in the system, process, and method discussed hereinafter may be implemented and/or executed by a computer or processor that is remote from the train (TR), where the remote computer or processor is in direct or indirect communication with a communication device 12 of the train (TR).

Figure 2A:
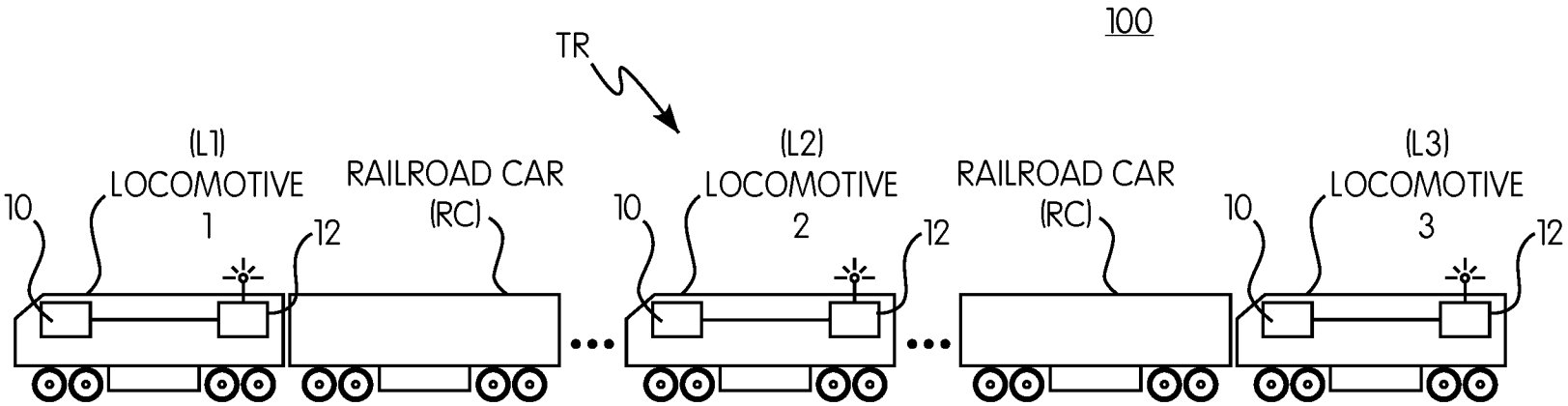
FIG. 2A is a schematic view of a train control system according to the principles of the present invention.
Figure 2B:
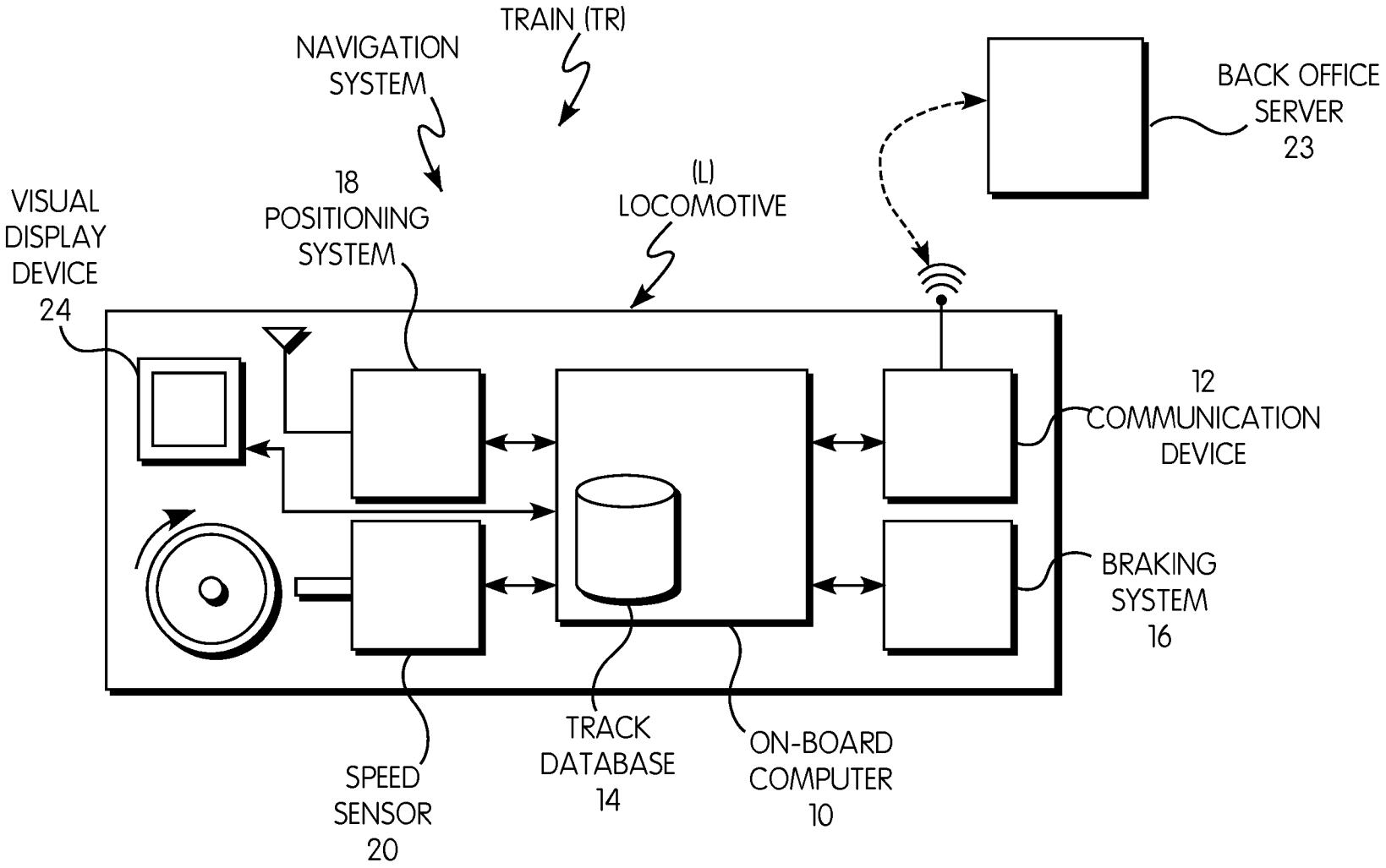
FIG. 2B is a schematic view of one embodiment of an arrival time and location targeting system according to the principles of the present invention.

With specific reference to FIGS. 2A and 2B, and in one preferred and non-limiting embodiment or aspect, provided is a wireless target activation system for a train (TR) including at least one locomotive or control car (L) and, optionally, one or more railcars (RC). For example, in one implementation, the train (TR) may include a plurality of locomotives (L1, L2, L3) and a plurality of rail cars (RC). In another implementation, the train (TR) may include only a single locomotive (L) and no rail cars (RC) or a plurality of rail cars (RC). The locomotive(s) (L) are equipped with at least an on-board computer 10 (e.g., an on-board controller, a train management computer, an on-board processor, and/or the like) programmed or configured to implement or facilitate at least one train action and a communication device 12 in communication with the on-board computer 10 and programmed or configured to receive, transmit, and/or process data signals. While the communication device 12 may be in the form of a wireless communication device (as illustrated in FIG. 2B), as discussed herein, this communication device 12 may also be programmed or configured to transmit, process, and/or receive signals over a trainline, using an ECP component, over the rails, and/or the like.

The system architecture used to support the functionality of at least some of the methods and systems described herein includes: the train management computer or on-board computer 10 (which performs calculations for or within the Positive Train Control (PTC) system, including navigation and enforcement calculations); the communication device 12 (or data radio) (which may be used to facilitate the communications between the on-board computers 10 in one or more of the locomotives or control cars (L) of a train (TR), communications with a wayside device, e.g., signals, switch monitors, wayside devices, and the like, and/or communications with a remote server, e.g., a back office server 23, a central controller, central dispatch, and/or); a track database 14 (which may include information about track positions or locations, switch locations, crossing locations, track heading changes, e.g., curves, distance measurements, train information, e.g., the number of locomotives or control cars (L), the number of railcars (RC), the number of conventional passenger cars, the number of control cars, the total length of the train (TR), the specific identification numbers of each locomotive or control car (L) where PTC equipment (e.g., an on-board computer 10) is located, and the like); a navigation system 16 (optionally including a positioning system 18 (e.g., a Global Positioning System (GPS)) and/or a wheel tachometer/speed sensor 20), such as in a PTC-equipped locomotive or control car (L); and a visual display device 24 (or operator interface), typically located in the locomotive or control car (L), which is in direct or indirect communication with the on-board computer 10 and provides information and data to the operator, such as the information, data, and/or screens as discussed hereinafter. It should also be recognized that some or all of the steps and processing described herein may be performed locally by the on-board computer 10 of the locomotive or control car (L), or alternatively, by another computer (e.g., a computer associated with the end-of-train unit, a computer associated with a wayside device, and the like) and/or a remote computer or server (e.g., the back office server 23, a remote computer or server associated with central dispatch, a central controller, a computer-aided dispatch system, and intermediate control computer, and the like).

Further, and as discussed, the on-board computer 10 includes or is in communication with the communication device 12 (e.g., a data radio, a communication interface, a communication component, and/or the like), which facilitates communication by or between locomotives or control cars (L) and/or the locomotive or control car (L) and some remote server or computer system, e.g., a central controller, a back office server 23, a remote server, central dispatch, back office PTC components, various wayside devices, such as signal or switch monitors, or other on-board computers 10 in the railway system. Further, this communication may occur wirelessly or in a "hard wired" form, e.g., over the rails of the track.

As discussed, the on-board computer 10 may be located at any position or orientation on the train (TR), and the on-board computer 10 (or on-board controller, on-board computer system, train management computer, and/or the like, and which performs the determinations and/or calculations for the Positive Train Control (PTC) system) includes or is in communication with the track database 14 populated with data and/or which receives specified data and information from other trains, remote servers, back office servers 23, central dispatch, and/or the like, where this data may include track profile data, train data, information about switch locations, track heading changes (e.g., curves, and distance measurements), train consist information (e.g., the number of locomotives, the number of cars, the total length of the train (TR), and/or the like), and/or the like. Of course, it is envisioned that any type of train management system can be used within the context and scope of the present invention.

A wireless target activation system and computer-implemented method as described herein may be implemented as part of or incorporate an arrival time and location targeting system as disclosed in U.S. patent application Ser. No. 15/176,362 filed concurrently herewith, the content of which is hereby incorporated by reference in its entirety. For example, as described in more detail below, the on-board computer (10) may employ features and aspects of the arrival time and location targeting system including time-based targeting to ensure that the train does not violate required warning times.

Figure 3:
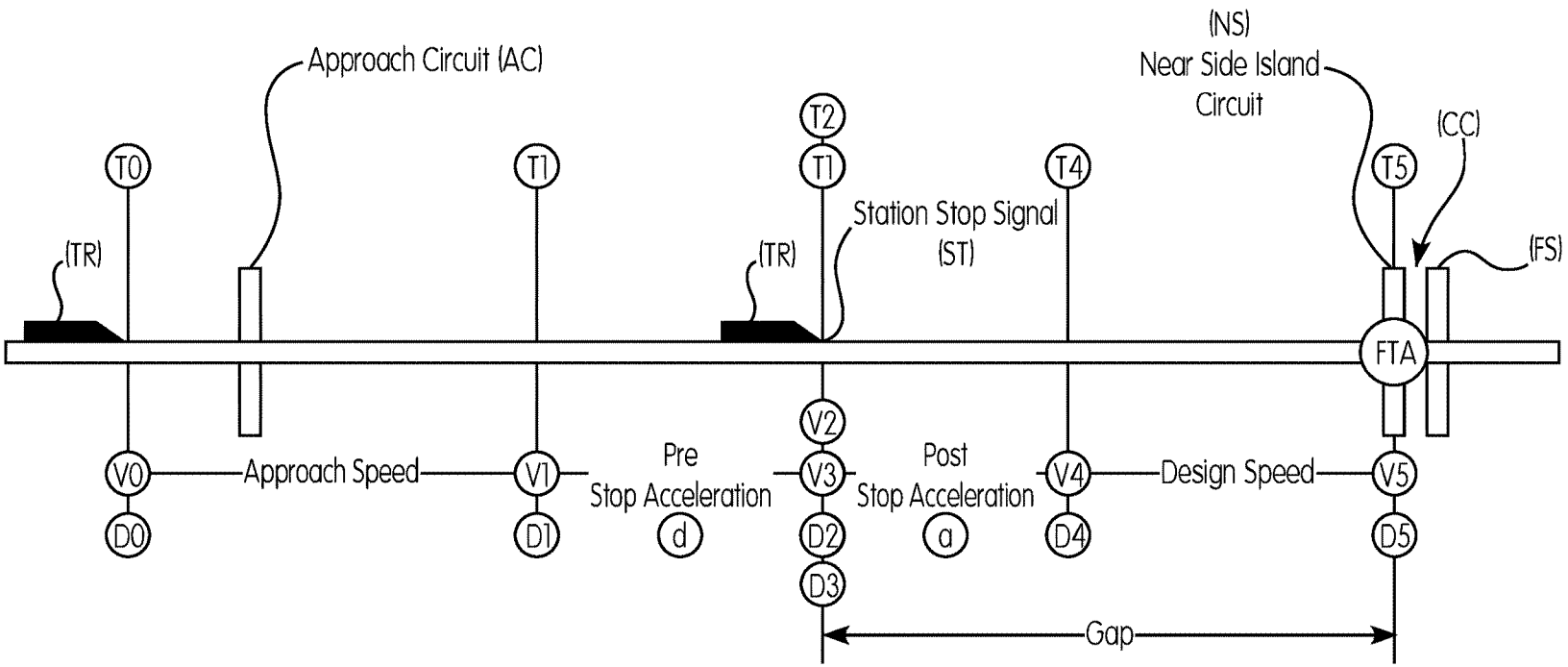
FIG. 3 is a schematic view of one implementation of an arrival time and location targeting system according to the principles of the present invention.

In one preferred and non-limiting embodiment, the on-board computer (10) (and/or a remote processor or server, e.g., the back office server 23) is programmed or configured to receive at least one first target location associated with a forward route of a train (TR), e.g., a station stop signal (ST) as shown in FIG. 3, and at least one second target location associated with the forward route of the train, e.g., a near side (NS) of an island crossing circuit (CC) as shown in FIG. 3. The at least one first target location is located before the at least one second target location on the forward route of the train. For example, as shown in FIG. 3, the station stop signal (ST) is located between a leading edge of the train (TR) and the near side (NS) of the island crossing circuit (CC).

FIG. 3 represents two points in time, namely a present point in time, i.e., Point A, and a future point in time, i.e., Point B, overlaid on a piece of track with an approach circuit (AC) and the island crossing circuit (CC) including the near side island circuit (NS) and a far side island circuit (FS). In FIG. 3, the variable indices 0, 1 & 2 are used for Point A in time and the variable indices 3, 4 & 5 are used for Point B in time. Point A in time represents a time, a location and a velocity or speed of the leading edge of the train (TR) at a starting point (0), a starting point of deceleration of the train (TR) as the train approaches the at least one first target location (1), e.g., a point before the station stop signal (ST), and a point at which the leading edge of the train (TR) stops or is stopped at the at least one first target location (2), e.g., at the station stop signal (ST). Point B in time represents a time, a location, and a velocity or speed of the leading edge of the train (TR) at a point that the train leaves or is leaving the at least one first target (3), e.g., the station stop signal (ST), an ending point of an acceleration of the train (TR) after leaving the at least one first target (4), e.g., after the station stop signal (ST), and a point at which the leading edge of the train (TR) reaches or arrives at the at least one second target (5), e.g., the near side (NS) of the island circuit crossing (CC).

The on-board computer (10) (and/or a remote processor or server, e.g., the back office server 23), for example, as part of its calculations for or within the PTC system, knows or receives the following variables: a velocity or speed of the train (TR) at points (0) and (1), which is equal to a current speed of the train (TR), i.e., V0=V1=current speed of the train (TR); a velocity or speed of the train at points (2) and (3), which is equal to 0 (zero) because the train is stopped at the station stop signal (ST), i.e., V2=V3=0; a velocity or speed of the train at points (4) and (5), which is equal to a design speed of the island crossing circuit (CC), i.e., V4=V5=design speed; a distance of the leading edge of the train (TR) to the station stop signal (ST) at points (2) and (3) is the same, i.e., D2=D3=distance of the leading edge of the train (TR) to the station stop signal (ST); a distance of the leading edge of the train (TR) to the near side (NS) of the island crossing circuit (CC), i.e., D5; an allowable deceleration, i.e., d=deceleration (negative value); and an allowable acceleration, i.e., a=acceleration (positive value). The design speed can be a design speed associated with the at least one second target, e.g., a desired speed at which the train (TR) should traverse the island circuit crossing (CC). The allowable acceleration and the allowable deceleration may be maximum values, for example, set by the PTC system, that limit the acceleration and the deceleration of the train to a maximum acceleration and a maximum deceleration. For example, the on-board computer (10) (and/or a remote processor or server, e.g., the back office server 23) can prevent the train (TR) from performing braking or tractive efforts that the on-board computer (10) determines would results in an unacceptable acceleration or deceleration of the train (TR).

The on-board computer (10) (and/or a remote processor or server, e.g., the back office server 23) can use the following equations (1)-(3) to model the present point in time, Point A:

$$V2 = V0 + d(T2 - Tl) \tag{1}$$

$$D1 - D0 = V0(Tl - T0) \tag{2}$$

$$D2 - D1 = V1(T2 - T1) + d\frac{(T2 - T1)^2}{2} \tag{3}$$

wherein, based on the Point A in time, T0=0; D0=0 and, wherein, D1 is a distance of the leading edge of the train (TR) to the station stop signal (ST) at point (1), e.g., a point at which the train (TR) begins pre-stop deceleration.

The on-board computer (10) (and/or a remote processor or server, e.g., the back office server 23) can use the following equations (4)-(6) to model the future point in time, Point B:

$$V4 = V3 + a(T4 - T3) \tag{4}$$

$$D5 - D4 = V5(T5 - T4) \tag{5}$$

$$D4 - D3 = V3(T4 - T3) + a\frac{(T4 - T3)^2}{2} \tag{6}$$

wherein D4 is a distance of the leading edge of the train (TR) to the near side (NS) of the island circuit crossing (CC) at point (4), e.g. a point at which the velocity or speed of the train (TR) reaches the design speed.

The on-board computer (10) (and/or a remote processor or server, e.g., the back office server 23) can determine an estimated time of arrival (ETA) of the leading edge of the train (TR) at the at least one first target location based at least partially on the current location of the leading edge of the train (TR) and the velocity or current speed of the train. For example, the on-board computer (10) (and/or a remote processor or server, e.g., the back office server 23) can determine an estimated time until (or at which) the leading edge of the train (TR) reaches the station stop signal (ST). As noted, based on the Point A in time, T0=0 and D0=0, and Equations (1) and (2) can thus be reduced to the following Equations (7) and (8):

$$0 = V0 + d(T2 - Tl) \tag{7}$$

$$D1 = V0 * Tl \tag{8}$$

The Equations (7) can be used to solve for (T2−T1) to arrive at the following Equation (9):

$$(T2 - T1) = \frac{-V0}{d} \tag{9}$$

Substitution of the value for (T2−T1) in Equation (9) into Equation 3 can reduce Equation (3) to the following Equation (10):

$$D2 - D1 = V1\left(\frac{-V0}{d}\right) + d\frac{\left(\frac{-V0}{d}\right)^2}{2} \tag{10}$$

Equation (10) can be further simplified to the following Equation (11):

$$D1 = D2 + \frac{V0^2}{2d} \tag{11}$$

Equations (8) and (7) can be rearranged as the following Equation (12) and (13):

$$T1 = \frac{D1}{V0} \tag{12}$$

$$T2 = \frac{-V0}{d} - T1 \tag{13}$$

Equation (12) can be substituted into Equation (13) to arrive at the following Equation (14):

$$T2 = \frac{-V0}{d} - \frac{D1}{V0} \tag{14}$$

Further substitutions for D1 and further simplification of Equation (14) can provide the following Equation (15):

$$T2 = \frac{D2}{V0} - \frac{V0}{2d} \tag{15}$$

wherein T2=an estimated time of arrival (ETA) of the leading edge of the train (TR) at the station stop signal (ST); V0=a current velocity or speed of the train; and D2=a distance of the leading edge of the train (TR) to the station stop signal (ST). The on-board computer (10) (and/or a remote processor or server, e.g., the back office server 23) can thus determine the ETA of the leading edge of the train (TR) at the station stop signal (ST) based on a current distance of the leading edge of the train (TR) to the station stop signal (ST), a current velocity or speed of the train (TR), and an allowable deceleration of the train (TR).

The on-board computer (10) (and/or a remote processor or server, e.g., the back office server 23) can determine a gap time between when the leading edge of the train (TR) leaves the at least one first target location and is estimated to arrive at the at least one second target location based at least partially on a distance between the at least one first target location and the at least one second target location and a design speed of the train (TR). For example, the on-board computer (10) (and/or a remote processor or server, e.g., the back office server 23) can determine a gap time between when the leading edge of the train (TR) leaves or is leaving the station stop signal (ST) and is estimated to arrive at the near side (NS) of the island circuit crossing (CC) based at least partially on a distance between the station stop signal (ST) and the near side (NS) of the island circuit crossing (CC) and a target or design speed of the train. Based on the Point B in time, the following variables are known: T3=0 and D3=0. As previously noted, V3=0. The Equations (4), (5), and (6) used to model the Point B in time, and the Equations (4) and (6) can be reduced to the following Equations (16) and (17):

$$V4 = a * T4 \tag{16}$$

$$D4 = a\frac{T4^2}{2} \tag{17}$$

The Equation (16) can be solved for T4, and V5 can be substituted for V4 therein to arrive at the following Equation (18):

$$T4 = \frac{V5}{a} \tag{18}$$

The value of T4 in the Equation (18) can be substituted into the Equation (17) to arrive at the following Equation (19):

$$D4 = a\frac{\left(\frac{V5}{a}\right)^2}{2} \tag{19}$$

which can be simplified to the following Equation (20):

$$D4 = \frac{V5^2}{2a} \tag{20}$$

The value of D4 in the Equation (20) can be substituted into the Equation (5) to arrive at the following Equation (21):

$$D5 - \frac{V5^2}{2 * a} = V5\left(T5 - \frac{V5}{a}\right) \tag{21}$$

The Equation (21) can be rearranged and simplified in the following manner as shown by Equations (22) to (25) to arrive at the Equation (26):

$$D5 - \frac{V5^2}{2 * a} = V5 * T5 - \frac{V5^2}{a} \tag{22}$$

$$D5 = V5 * T5 - \frac{V5^2}{a} + \frac{V5^2}{2 * a} \tag{23}$$

$$D5 = V5 * T5 - \frac{V5^2}{2 * a} \tag{24}$$

$$V5 * T5 = D5 + \frac{V5^2}{2 * a} \tag{25}$$

$$T5 = \frac{D5}{V5} + \frac{V5}{2 * a} \tag{26}$$

wherein T5=the gap time; V5=the design speed; and a=the allowable acceleration. Because D3 was assumed to be 0 (zero) to solve for the Equation (21), D5 represents the gap distance between the station stop signal (ST) and the near side (NS) of the island crossing circuit (CC). The on-board computer (10) (and/or a remote processor or server, e.g., the back office server 23) can thus determine the gap time, i.e., the time it takes the train (TR) to traverse the gap between the station stop signal (ST) and the near side (NS) of the island crossing circuit (CC) based on the gap distance, the design speed, and the allowable acceleration. It should be noted, however, that if the distance between the at least one first target location and the at least one second target location is too short to reach the design speed based on the allowable acceleration, the on-board computer (10) (and/or a remote processor or server, e.g., the back office server 23) is programmed or configured to set the design speed of the train to be $\sqrt{2*a*gd}$, wherein a is the allowable acceleration and gd is the distance between the at least one first target location and the at least one second target location. For example, if the gap distance is too short for the train (TR) to reach the design speed, the velocity or speed of the train at the crossing, i.e., V5, is based on the following Equation (27):

$$V5=\sqrt{2*a*D5} \tag{27}$$

wherein V5 is the velocity or speed of the train (TR) at the crossing, a is the allowable acceleration, and D5 is the gap distance. The on-board computer (10) (and/or a remote processor or server, e.g., the back office server 23) can use this speed instead of the design speed to calculate the gap time if it determines that the gap distance is too short for the train (TR) to reach the design speed.

The on-board computer generates an activation message configured to activate a function associated with the at least one second target location based at least partially on the estimated time of arrival of the leading edge of the train (TR) at the at least one first target location, a dwell time of the leading edge of the train (TR) at the at least one first target location, the gap time, an allowable acceleration of the train, and a required warning time. For example, the activation message may include a timestamp that indicates a time at which to activate the at least one function associated with the at least one second target location, e.g., a time to activate the wireless crossing circuit (CC) gates and/or warning notifications. The communications device (12) can transmit the activation message to the wireless crossing circuit (CC) itself, or to the back office server 23 or other PTC component configured to control the functions of the wireless crossing circuit (CC). In another implementation, the activation message may be configured to activate the at least one function of the at least one second target location immediately upon its receipt. For example, the on-board computer (10) (and/or a remote processor or server, e.g., the back office server 23) may control the communications device (12) to transmit the activation message to the wireless crossing circuit (CC) at the time to activate the at least one function of the at least one second target location to immediately trigger the activation of the wireless crossing circuit (CC) upon its receipt thereby. The dwell time may be a time period during which the train (TR) is supposed to or instructed to remain stopped at the station stop signal (ST). For example, the station stop signal (ST) can have a desired or preset time period associated therewith or a dynamic time period set based on time of day or other factors that influence train operations that indicates to the on-board computer (10) (and/or a remote processor or server, e.g., the back office server 23) and/or the operator of the train (TR) a time at which the train (TR) can leave the station stop signal (ST).

The on-board computer (10) (and/or a remote processor or server, e.g., the back office server 23) can calculate the ETA of the leading edge of the train (TR) to the near side (NS) of the island crossing circuit (CC) based on the ETA of the leading edge of the train (TR) to the station stop signal (ST), a dwell time of the train (TR) at the station stop signal (TR), the gap time of the train (TR), and the allowable acceleration of the train (TR). For example, a time to crossing=time to station+dwell time+gap time−allowable acceleration. The on-board computer (10) (and/or a remote processor or server, e.g., the back office server 23) can adjust for a required warning time, e.g., a maximum crossing time associated with the island crossing circuit (CC). For example, a station release timestamp=a current timestamp+(time to crossing−required warning time). The calculated station release timestamp may be used for a situation where the train (TR) adheres to an associated schedule of stopping at the station stop signal (ST) and dwelling at the station for the appropriate or predetermined amount of time. However, if the train (TR) does not stop at the station stop signal (ST) or does not dwell at the station for the appropriate or predetermined amount of time, the on-board computer (10) (and/or a remote processor or server, e.g., the back office server 23) can perform one or more operations to ensure that the required warning time and the allowable acceleration are still enforced.

In one preferred and non-limiting embodiment, the on-board computer (10) (and/or a remote processor or server, e.g., the back office server 23) can be programmed or configured to determine required time of arrival of the leading edge of the train (TR) at the at least one second target location based at least partially on the required warning time and determine the estimated time of arrival of the leading edge of the train (TR) at the at least one second target location based at least partially on a location of the leading edge of the train (TR) and a velocity or speed of the train (TR) after the leading edge of the train (TR) leaves the at least one first target location. The on-board computer (10) (and/or a remote processor or server, e.g., the back office server 23) can generate a target speed of the train based at least partially on the difference between the determined required time of arrival and the determined estimated time of arrival. For example, as disclosed in U.S. patent application Ser. No. 15/176,362 incorporated herein by reference, the on-board computer (10) (and/or a remote processor or server, e.g., the back office server 23) can determine the required acceleration (or deceleration) time to generate the target speed of the train (TR) to meet the required time of arrival, i.e., to arrive at the near side (NS) of the island crossing circuit (CC) substantially at the moment that the required warning time is satisfied. The on-board computer (10) (and/or a remote processor or server, e.g., the back office server 23) can use the target speed of the train in place of the design speed to ensure that the train does not violate the required warning time by arriving at the near side (NS) of the island crossing circuit (CC) too early or too late.

In one preferred and non-limiting embodiment, the on-board computer (10) (and/or a remote processor or server, e.g., the back office server 23) can generate and/or send the activation message after the leading edge of the train (TR) leaves the at least one first target location, e.g., after the leading edge of the train (TR) leaves the station stop signal (ST). The on-board computer (10) (and/or a remote processor or server, e.g., the back office server 23) calculates the gap time as a fixed amount of time that assumes some degree of "normalcy" in train operations, e.g., the train stops at the station stop signal (ST) and remains at the station stop signal (ST) for the appropriate amount of dwell time, but errs on the side of caution. The gap time can be used to divide the station release logic into two parts, pre-station stop and post station stop. If the on-board computer (10) (and/or a remote processor or server, e.g., the back office server 23) determines that the gap time plus the allowable acceleration is greater than the required warning time, e.g., a maximum crossing time of the island crossing, the on-board computer (10) (and/or a remote processor or server, e.g., the back office server 23) can generate the activation message after the station stop or post-station. For example, the activation message can include a timestamp to activate the wireless crossing circuit or, be generated and transmitted, after the leading edge of the train (TR) leaves the station stop signal. For example, the on-board computer (10) (and/or a remote processor or server, e.g., the back office server 23) can generate a station release message configured to activate the wireless crossing after the leading edge of the train leaves the station stop signal. The on-board computer (10) (and/or a remote processor or server, e.g., the back office server 23) can determine a timestamp (or transmit time) for the post station stop activation message, e.g., an amount of time after the leading edge of the train (TR) leaves the station stop signal (ST) that the timestamp in the activation message indicates to activate the wireless crossing (or an amount of time after the leading edge of the train (TR) leaves the station stop signal (ST) that the activation message should be sent) based on the gap time, the required warning time, and the allowable acceleration. For example, the on-board computer (10) (and/or a remote processor or server, e.g., the back office server 23) can determine the release time after the station stop signal (ST) as equal to the following: gap time−(required warning time+allowable acceleration), and the station release timestamp=left station timestamp+the release time after the station stop.

In one preferred and non-limiting embodiment, the on-board computer (10) (and/or a remote processor or server, e.g., the back office server 23) can generate or send the activation message before the leading edge of the train leaves the at least one first target location. If the on-board computer (10) (and/or a remote processor or server, e.g., the back office server 23) determines that a post station stop release scenario is not appropriate or expected, for example, the on-board computer (10) (and/or a remote processor or server, e.g., the back office server 23) determines that the gap time plus the allowable acceleration is greater than the required warning time, e.g., a maximum crossing time of the island crossing, the on-board computer (10) (and/or a remote processor or server, e.g., the back office server 23) can determine that a pre-station stop release is needed. The on-board computer (10) (and/or a remote processor or server, e.g., the back office server 23) can include the dwell time in the pre-station stop. For example, a pre-station release can be any release that occurs prior to the leading edge of the train (TR) leaving the station stop. For pre-station stop releases, the on-board computer 10 (and/or a remote processor or server, e.g., the back office server 23) can calculate the ETA of the leading edge of the train to the crossing based on the ETA of the leading edge of the train to the station stop signal, a dwell time of the train at the station stop signal, gap time of the train (TR), and the allowable acceleration of the train (TR), e.g., using Equation (26) (and, if needed, Equation (27)). For example, as noted, the on-board computer can determine a time to crossing of the leading edge of the train as equal to the following: a time to station+Dwell Time+Gap Time−Allowable Acceleration. The on-board computer (10) (and/or a remote processor or server, e.g., the back office server 23) can adjust for a required warning time, e.g., a maximum crossing time associated with the island crossing. For example, the activation message can include a station release timestamp having a timestamp=a current timestamp+(time to crossing−required warning time).

In one preferred and non-limiting embodiment, the on-board computer (10) (and/or a remote processor or server, e.g., the back office server 23) is programmed or configured to automatically generate the activation message if the leading edge of the train (TR) leaves the at least one first target location at a time when a summation of the gap time and the allowable acceleration is less than the required warning time. For example, if a pre-station stop condition is expected, but fails to happen due to either the train (TR) not stopping at the station stop signal (ST) or the train (TR) leaving the station earlier than expected, (e.g., the train leaves the station without a station release message occurring when the on-board computer (10) (and/or a remote processor or server, e.g., the back office server 23) has deterniined that a pre-station stop release is needed), the on-board computer (10) (and/or a remote processor or server, e.g., the back office server 23) can automatically generate and transmit the activation message immediately after the leading edge of the train (TR) leaves the station stop signal (ST).

Accordingly, the on-board computer (10) (and/or a remote processor or server, e.g., the back office server 23) can enforce the required warning time plus the allowable acceleration from the time a station release message is sent regardless of whether a post station stop release, a positive pre-station stop release, or a negative pre-station stop release scenario occurs for the train (TR). A wireless target activation system according to a preferred and non-limiting embodiment can thus mitigate variances from normal conditions that may occur when the train is traversing the crossing approach and island crossing circuits.

Examples in which the above equations are used to determine a time to activate a wireless crossing located after a station stop signal on a forward route of a train are shown in the following table. Table 1 shows results for a crossing with a 7000 foot approach where a location of the station stop signal (ST) along the approach is varied. The table reflects how different locations of the station stop signal (ST) changes the scenario based on gap time. In the examples shown in the following table, the following variables are used: acceleration=1.6 mph/s$^2$ or 2.35 fps/s$^2$; deceleration=−3 mph/s$^2$ or −4.40 fps/s$^2$; design speed=65 mph or 95.33 fps; dwell time=20 s; maximum crossing time=42 s; and D5-D0=7000 ft. A time buffer that allows for some increase in speed without violating the desired crossing time can be assumed to be 6 seconds.

(TR) to reach the design speed, based on the equation (27). The column labeled "Gap Time Max Speed<Design Speed" shows the time to traverse the gap under constant acceleration, i.e., V5 from equation (27) plugged back into Equation (26). The column labeled "Gap Time Max Speed>Design Speed" shows results of Equation (26) with V5=design speed. The column labeled "Gap Time T5" is the end result of which gap time the onboard computer (10) determines should be used. For example, if second gap time, i.e., Gap Time Max Speed>Design Speed, is greater than the first, the onboard computer (10) uses the first gap time. As can be seen in Table 1, when a calculated time to release is greater than the departure time of the station, the onboard computer (10) can determine a pre-station departure release verses a post-station departure release.

In another preferred and non-limiting embodiment, the on-board computer (10) (and/or a remote processor or server, e.g., the back office server 23) can be configured to generate a message configured to activate at least one crossing associated with a forward route of the train in response to actuation of at least one locomotive control. For example, an operator of the train (TR) can activate the automatic crossing activation function of the island crossing circuit (CC) manually by pushing a button in the locomotive. The button can be a physical button or button displayed on a touchscreen provided in the operator interface 24.

Figure 4A:
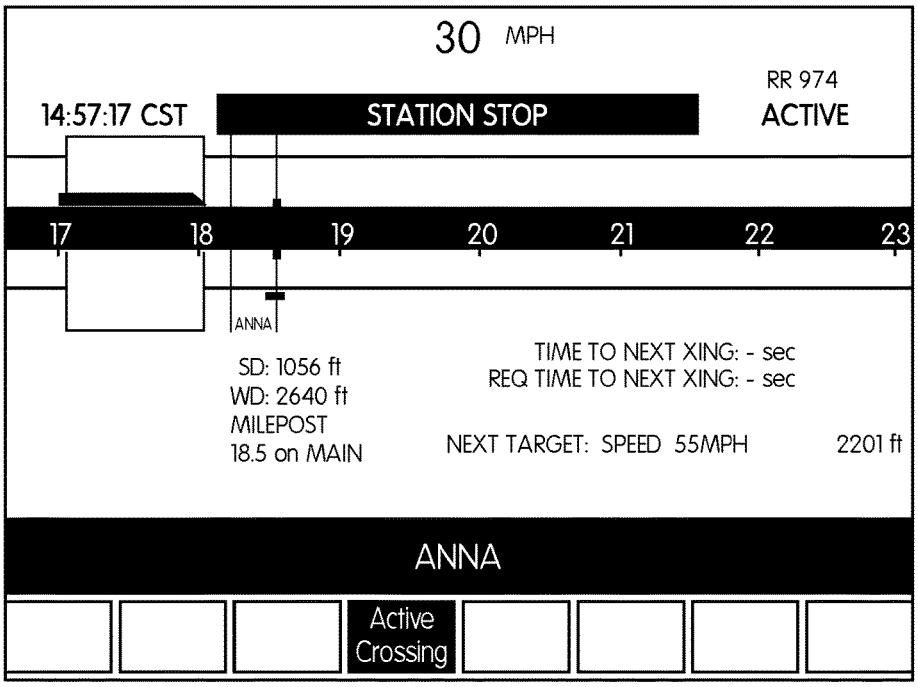
FIG. 4A is an example graphical representation of an operator interface of an wireless activation system according to principles of the present invention.
Figure 4B:
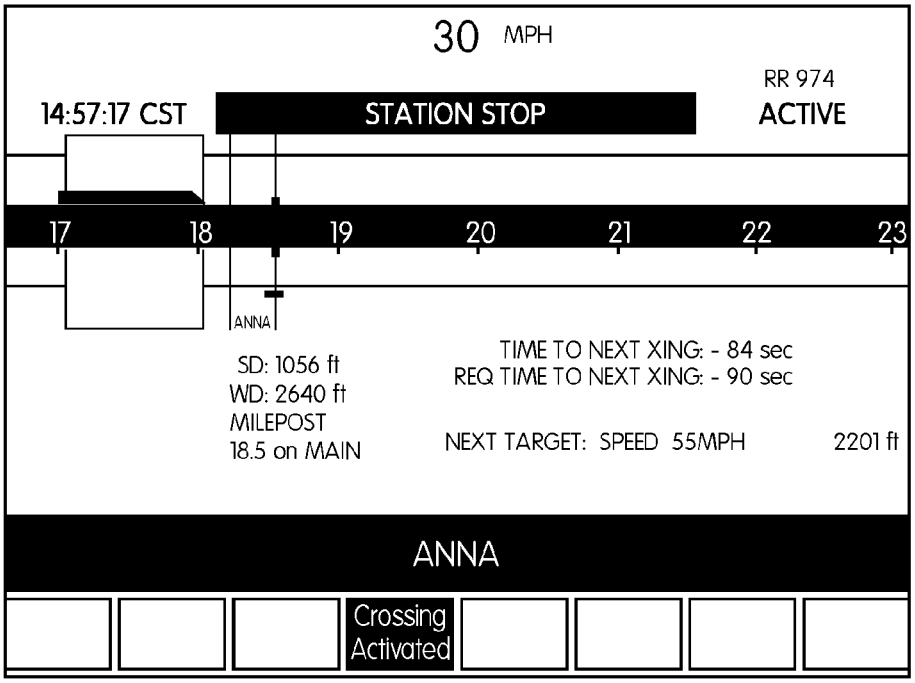
FIG. 4B is an example graphical representation of an operator interface of wireless activation system according to principles of the present invention.

FIGS. 4A and 4B show an example graphical representation of an operator interface of wireless activation system. Under certain conditions, it may be desirable for the operator of the train (TR) to override an automatic crossing activation function and start the crossing manually. The operator interface 24 can provide the operator with an option of selecting an "Activate Crossing" button that controls the on-board computer (10) (and/or a remote processor or server, e.g., the back office server 23) and communications device (12) to generate and send an activation message to the wireless crossing circuit (CC) (or to the back office server 23 or other PTC component configured to control the functions of the wireless crossing circuit (CC)) to activate the wireless crossing.

In one implementation, the on-board computer (10) (and/or a remote processor or server, e.g., the back office server 23) can be programmed or configured to enable actuation of the at least one locomotive control based on at least one of a location of the leading edge of the train (TR) and a speed of the train. In another implementation, the on-board computer (10) (and/or a remote processor or server, e.g., the back office server 23) can be programmed or configured to enable actuation of the at least one locomotive control in response

TABLE 1

| V0 (mph) | V0 (fps) | D2-D0 (ft) | Time to Station Stop T2 (sec) | Time to Station Departure T3 (sec) | Gap distance D5-D3 (ft) | Max Speed at Crossing from Gap (fps) | Gap Time Max Speed < Design Speed (sec) | Gap Time Max Speed > Design Speed (sec) | Gap Time T5 (sec) | Time to Crossing (sec) | Relative Time to Release (sec) | Pre or Post Station Release |
|---|---|---|---|---|---|---|---|---|---|---|---|---|
| 63 | 92.4 | 6500 | 80.85 | 100.85 | 500 | 48.44 | **20.64** | 25.56 | **20.64** | 121.49 | 73.49 | Pre |
| 63 | 92.4 | 6000 | 75.44 | 95.44 | 1000 | 68.51 | **29.19** | 30.80 | **29.19** | 124.63 | 76.63 | Pre |
| 63 | 92.4 | 5500 | 70.02 | 90.02 | 1500 | 83.90 | **35.75** | 36.05 | **35.75** | 125.78 | 77.78 | Pre |
| 63 | 92.4 | 5000 | 64.61 | 84.61 | 2000 | 96.88 | 41.29 | 41.29 | 41.29 | 125.90 | 77.90 | Pre |
| 63 | 92.4 | 4500 | 59.20 | 79.20 | 2500 | 108.32 | 46.16 | ***46.54*** | ***46.54*** | 125.74 | 77.74 | Pre |
| 63 | 92.4 | 4000 | 53.79 | 73.79 | 3000 | 118.66 | 50.56 | ***51.78*** | ***51.78*** | 125.57 | 77.57 | Post |
| 63 | 92.4 | 3500 | 48.38 | 68.38 | 3500 | 128.17 | 54.62 | ***57.03*** | ***57.03*** | 125.40 | 77.40 | Post |
| 63 | 92.4 | 3000 | 42.97 | 62.97 | 4000 | 137.02 | 58.39 | ***62.27*** | ***62.27*** | 125.24 | 77.24 | Post |

The bolded, underlined values and the bolded, italicized values represent whether gap time was determined based on design speed or, if the gap distance is too short for the train to a message received from a station stop signal (ST) located in advance of the crossing circuit (CC) on the forward route of the train (TR). For example, the availability of the "Activate Crossing" button can be on a station by station basis. Stations that are configured to use the crossing activation button can enable display of the button when the train has reached the station and the wheel tach speed of the train (TR) is below a tolerance that indicates that the train (TR) has stopped. For example, as shown in FIG. 4A, the "Activate Crossing" button is not enabled, which is indicated by a yellow background. In FIG. 4B, the "Activate Crossing" button is enabled, which is indicated by a green button. After the button is pressed by the operator and activation of the crossing is confirmed, the operator interface (24) can indicate that the crossing has activated and the train (TR) is allowed to proceed.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A wireless target activation system for a train comprising at least one locomotive or control car, the system comprising at least one computer programmed or configured to:

receive at least one first target location associated with a forward route of the train;

receive at least one second target location associated with the forward route of the train, wherein the at least one first target location is located before the at least one second target location on the forward route of the train;

determine a gap time between when the leading edge of the train leaves the at least one first target location and is estimated to arrive at the at least one second target location based at least partially on a distance between the at least one first target location and the at least one second target location and a design speed; and based at least partially on the gap time, an allowable acceleration of the train, and a required warning time, generate an activation message configured to activate or cause the activation of at least one function associated with the at least one second target location, wherein if the distance between the at least one first target location and the at least one second target location is too short to reach the design speed based on the allowable acceleration, the at least one computer is programmed or configured to set the design speed of the train to be the following:

$$\sqrt{2*a*gd}$$

wherein a is the allowable acceleration and gd is the distance between the at least one first target location and the at least one second target location.

2. The wireless target activation system of claim 1, wherein the activation message is generated after the leading edge of the train leaves the at least one first target location.

3. The wireless target activation system of claim 1, wherein the activation message is generated before the leading edge of the train leaves the at least one first target location.

4. The wireless target activation system of claim 1, wherein the at least one computer is programmed or configured to automatically generate the activation message if the leading edge of the train leaves the at least one first target location at a time when a summation of the gap time and the allowable acceleration is less than the required warning time.

5. The wireless target activation system of claim 1, wherein the at least one computer is programmed or configured to:

determine an estimated time of arrival of the leading edge of the train at the at least one first target location based at least partially on the current location of the leading edge of the train and the current speed of the train; and based at least partially on the estimated time of arrival of the leading edge of the train at the at least one first target location, a dwell time of the train at the at least one first target location, the gap time, the allowable acceleration of the train, and the required warning time, generate the activation message configured to activate or cause the activation of the function associated with the at least one second target location.

6. The wireless target activation system of claim 5, wherein the activation message is generated before the leading edge of the train leaves at the at least one first target location.

7. The wireless target activation system of claim 5, wherein the at least one computer is programmed or configured to automatically generate the activation message if the leading edge of the train leaves the at least one first target location at a time when a summation of the gap time and the allowable acceleration is less than the required warning time.

8. The wireless target activation system of claim 5, wherein the activation message is generated after the leading edge of the train leaves the at least one first target location.

9. The wireless target activation system of claim 1, wherein the at least one computer is programmed or configured to generate at least one inhibit message configured to inhibit or prevent, or cause the inhibition or prevention of, activation of the function of the at least one second target.

10. The wireless target activation system of claim 9, wherein the at least one computer is programmed or configured to generate the inhibit message before the leading edge of the train arrives at at least one third target location, the at least one third target location before the at least first target location and the at least one second target location on the forward route of the train.

11. The wireless target activation system of claim 1, wherein the design speed is a design speed associated with the at least one second target.

12. The wireless target activation system of claim 1, wherein the at least one computer is programmed or configured to:

determine required time of arrival of the leading edge of the train at the at least one second target location based at least partially on the required warning time;

determine the estimated time of arrival of the leading edge of the train at the at least one second target location based at least partially on a location of the leading edge of the train and a speed of the train after the leading edge of the train leaves the at least one first target location; and based at least partially on the difference between the determined required time of arrival and the determined estimated time of arrival, generate a target speed of the train.

13. The wireless target activation system of claim 1, wherein the at least one first target location comprises a station stop signal and the at least one second target location comprises a near side of an island crossing.

14. The wireless target activation system of claim 1, wherein the activation message comprises a timestamp that indicates a time at which to activate the at least one function associated with the at least one second target location.

15. A wireless target activation system for a train comprising at least one locomotive or control car, the system comprising an at least one computer programmed or configured to:

receive at least one first target location associated with a forward route of the train;

receive at least one second target location associated with the forward route of the train, wherein the at least one first target location is located before the at least one second target location on the forward route of the train;

determine an estimated time of arrival of the leading edge of the train at the at least one first target location based at least partially on the current location of the leading edge of the train and the current speed of the train;

determine a gap time between when the leading edge of the train leaves the at least one first target location and is estimated to arrive at the at least one second target location based at least partially on a distance between the at least one first target location and the at least one second target location and a design speed of the train; and based at least partially on the estimated time of arrival of the leading edge of the train at the at least one first target location, a dwell time of the leading edge of the train at the at least one first target location, the gap time, an allowable acceleration of the train, and a required warning time, generate an activation message configured to activate or cause the activation of a function associated with the at least one second target location.

16. A computer-implemented wireless target activation method for a train comprising at least one locomotive or control car, the method comprising:

receiving at least one first target location associated with a forward route of the train;

receiving at least one second target location associated with the forward route of the train, wherein the at least one first target location is located before the at least one second target location on the forward route of the train;

determining an estimated time of arrival of the leading edge of the train at the at least one first target location based at least partially on the current location of the leading edge of the train and the current speed of the train;

determining a gap time between when the leading edge of the train leaves the at least one first target location and is estimated to arrive at the at least one second target location based at least partially on a distance between the at least one first target location and the at least one second target location and a design speed; and based at least partially on the estimated time of arrival of the leading edge of the train at the at least one first target location, a dwell time of the leading edge of the train at the at least one first target location, the gap time, an allowable acceleration of the train, and a required warning time, generating an activation message configured to activate or cause the activation of at least one function associated with the at least one second target location.

* * * * *